United States Patent [19]

Fränkle et al.

[11] Patent Number: 4,522,164

[45] Date of Patent: Jun. 11, 1985

[54] COLD-START ASSISTING DEVICE FOR COMBUSTION ENGINES

[75] Inventors: Gerhard Fränkle, Remshalden; Peter Joppig, Korb, both of Fed. Rep. of Germany

[73] Assignee: Daimler-Benz Aktiengesellschaft, Stuttgart, Fed. Rep. of Germany

[21] Appl. No.: 486,806

[22] Filed: Apr. 20, 1983

[30] Foreign Application Priority Data

Jun. 18, 1982 [DE] Fed. Rep. of Germany ..... 3222941

[51] Int. Cl.[3] ..... F02M 1/16

[52] U.S. Cl. ..... 123/180 R; 123/180 AC; 123/180 E; 123/180 T

[58] Field of Search ..... 123/179 G, 179 L, 180 R, 123/180 AC, 180 E, 180 T, 187.5 R

[56] References Cited

U.S. PATENT DOCUMENTS

| | | | |
|---|---|---|---|
| 1,058,209 | 4/1913 | Webb et al. | 123/180 AC |
| 2,945,483 | 7/1960 | Howell | 123/180 R |
| 3,573,482 | 4/1971 | Brooks et al. | 123/179 G |
| 3,960,131 | 6/1976 | Davis | 123/187.5 R |
| 4,346,683 | 8/1982 | Burke | 123/180 R |

*Primary Examiner*—Andrew M. Dolinar

*Attorney, Agent, or Firm*—Barnes & Thornburg

[57] ABSTRACT

The invention relates to a cold-start assisting device for motor vehicles with which under extreme cold conditions, in addition to the normal fuel, auxiliary fluid is also injected into the intake of the vehicle combustion engine by means of a control switch. With this operating or control switch it is also possible after a successful start to support the running of the combustion engine with auxiliary injection. In order to prevent intentional or inadvertent operation of the auxiliary injection with a stalled engine, the control switch exhibits an auxiliary working contact which is connected with a terminal of a motor driven generator.

16 Claims, 1 Drawing Figure

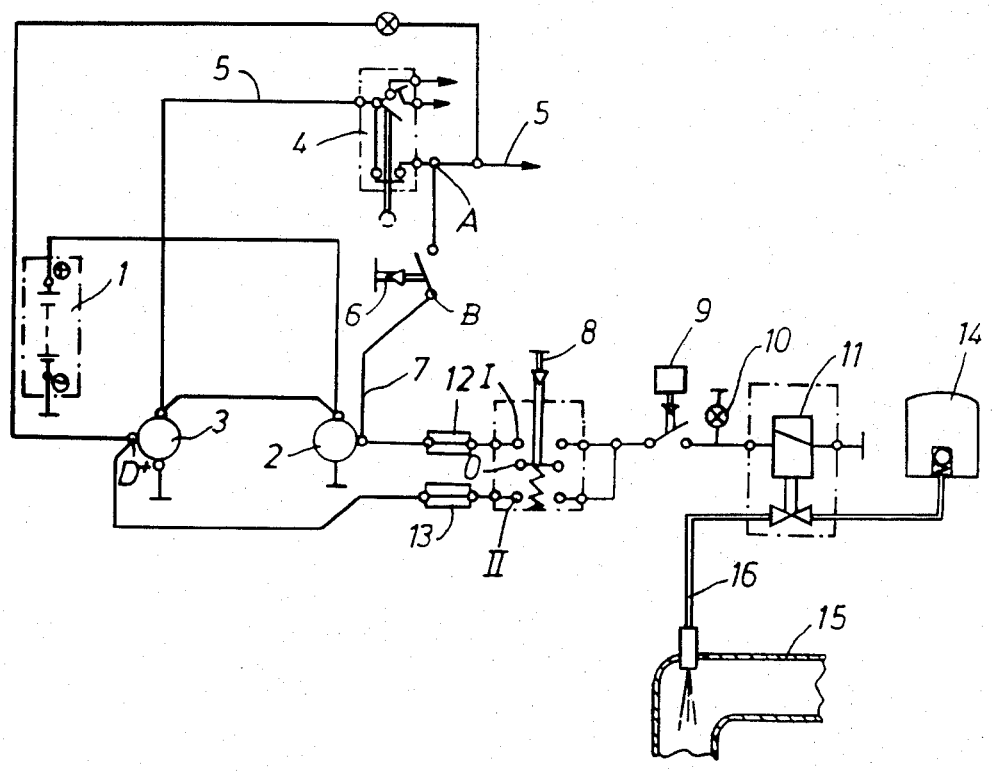
5
5
4
A
1
6
B
9
8
10
11
14
7
12
I
3
2
D
0
13
II
16
15

COLD-START ASSISTING DEVICE FOR COMBUSTION ENGINES

BACKGROUND AND SUMMARY OF THE INVENTION

The invention relates to a cold-start assisting device for controlling the supply of an auxiliary fluid, especially an ether containing auxiliary fluid, to the inlet lines of a combustion engine with ignition and starting circuits, which assisting device operates a valve at a connecting line for the auxiliary fluid by means of a starting switch and a control switch during starting operation and by means of the control switch after a successful start.

An apparatus or device to facilitate engine starting with low temperatures is known from U.S. Pat. No. 4,202,309, wherein auxiliary fluid is injected by means of a temperature responsive starting switch. The function of this arrangement is limited to the starting procedure.

In U.S. Pat. No. 2,679,837 an apparatus is made known, with which not only during the starting, but rather also after a successful start, for example during unsteady running or idling of the combustion engine, auxiliary fluid in the form of heated fuel can be injected by means of a control switch.

The invntion addresses the problem of preventing by simple means a careless or intentional operation of a cold-start assisting arrangement which provides auxiliary starting fluid injection to a stalled engine, thereby avoiding the related dangers to the engine.

These problems are solved according to the present invention by providing that the cold-start assisting device control switch has an auxiliary working contact for a further switch position, which is connected with one of the terminals of a dynamo or generator, which auxiliary contact exhibits a relatively negative electrical potential with a non-operating generator and a positive electrical potential during operation of the generator. Thus, auxiliary injection is automatically prevented since, even with the control switch pushed to an auxiliary injection position with a stalled engine, the absence of electrical potential at the generator terminal in the circuit prevents injection.

Through the inventive security measures, during tapping (light touching) of the control switch with engaged ignition and a stalled engine, injection of the auxiliary fluid is avoided simply, whether the tapping of the control switch is intentional or unintentional. A disturbance of the motor by injecting auxiliary fluid under these conditions is thereby avoided.

The special switch connection has the further advantage that an injection of the auxiliary fluid during a push-start of the engine with defective batteries is possible since the pushing will operate the generator and raise the voltage at its terminal so as to permit the auxiliary injection.

These and further objects, features, and advantages of the present invention will become more obvious from the following description when taken in connection with the accompanying drawing which shows, for purposes of illustration only, a single embodiment in accordance with the present invention.

BRIEF DESCRIPTION OF THE DRAWING

The single drawing FIGURE is a schematic circuit diagram for a cold-start assisting device constructed in accordance with a preferred embodiment of the invention.

DETAILED DESCRIPTION OF THE DRAWING

In the drawing and in the following description only those features necessary to an understanding of the invention are shown and described in detail, in order not to obscure the invention. Those skilled in the art, given the state of the art, as exemplified by the above-referenced U.S. Pat. Nos. 2,679,837 and 4,202,309, and given the present disclosure, should readily be able to practice the present invention.

Referring to the drawing, a cold-start assisting device is provided with current from a battery 1. In this circuit diagram there is shown a starter 2, a dynamo or generator 3, and a switching unit 4. The switching unit 4 closes to connect an ignition circuit 5 and a starting circuit 7 by means of contacts A and B. The starting circuit 7 is switched-on by means of the starting switch 6. control switch 8, constructed as a multiple function switch, includes a working contact I. A second working contact II of switch 8 is connected with a contact D+ (dynamo +) of the dynamo or generator 3.

In the switch position II, the control switch 8 is without self-locking (not latched) and is configured as a push-button switch. The control switch 8 preferably exhibits a rest position so that the auxiliary injection need not be provided for each start-up operation, which could lead to higher consumption of the starting fluid.

In the circuit diagram, in addition to the control switch 8 there is also a temperature switch 9 which is controlled depending upon the cooling water temperature of the engine, a control light (indicator lamp) 10, as well as an electromagnetic (solenoid) operated valve 11, arranged in series. Fuses in the control switch 8 circuit are designated with reference numbers 12 and 13.

Auxiliary fluid is stored in container 14 and is selectively supplied to the inlet or intake 15 to an internal combustion engine by means of auxiliary fluid supply line 16. Flow through line 16 is controlled by the electro-magnetically operated valve 11.

Following is a description of the swtiching function with the arrangement shown in the drawing.

Before the engine starting operation, the control switch 8 is switched to position I. Upon operation of the starting switch 6, the magnetic valve 11 is controlled by temperature responsive switch 9 to open line 16 and permit ether containing the auxiliary starting fluid to flow from reservoir 14 through line 16 and into the engine intake line 15, whenever the ambient temperature is below a predetermined value. In preferred embodiments, the temperature responsive switch 9 is arranged to be closed (in the auxiliary starting fluid supply actuating position) for engine cooling water temperatures below 20° centigrade and to be opened (in the auxiliary starting fluid supply non-actuating position) for engine cooling water temperatures above 20° centigrade. After the starting operation, control switch 8 can be activated to position II to provide for the supply of auxiliary fluid in the event the engine is missing or running improperly.

Because working contact II of control switch 8 is connected with the terminal D+ at the dynamo or generator 3, it is assured that with a stopping of the motor (and consequent change in the polarity of terminal D+) and an engaged ignition circuit switch, the supply of auxiliary fluid is prevented even if the control switch 8 is intentionally or inadvertently tapped or pushed to position II. Since with a non-operating generator 3 the contact D+ is negative, the present invention provides a very simple automatic system for protecting against undesired auxiliary fluid injection with a stopped motor.

During a stopping of the motor with switched-on ignition, the result of a touching of the control switch (toward switch position II) is that there is no opening of the magnetic valve 11 and thereby no auxiliary injection into the inlet line 15 because with a non-operating generator 3 the contact D+ is negative. As soon as the generator 3 comes into operation, the contact or terminal D+ changes from negative to positive so that it is then possible to select further the injection of the ether containing auxiliary fluid as an ignition or starting assistance.

While we have shown and described a preferred embodiment in accordance with the present invention, it is understood that the same is not limited thereto but is susceptible to numerous changes and modifications as would be known to those skilled in the art of the present disclosure, and we therefore do not wish to be limited to the details shown and described therein, but intend to cover all such changes and modifications as are encompassed by the scope of the appended claims.

We claim:

1. Cold-start assisting device for controlling the supply of an auxiliary fluid to an intake of a combustion engine with ignition and starting circuits, which assisting device operates a valve in a line for coupling the auxiliary fluid source to the intake, means for operating said valve via a starting switch and a control switch during starting operations and via a terminal of a generator and the control switch independently of the starting switch after a successful start, wherein the control switch exhibits an auxiliary working contact for a switch position which is connected with said terminal of the generator, which terminal exhibits a positive electrical potential only during operation of the generator, whereby inadvertent operation of the assisting device with engine ignition on and a stalled engine is automatically prevented.

2. Cold-start assisting device according to claim 1, wherein the control switch in the auxiliary position is a non-latching push-button switch.

3. Cold-starting assisting device according to claim 1, wherein said auxiliary fluid is an ether containing fluid.

4. Cold-start assisting device according to claim 2, wherein said auxiliary fluid is an ether containing fluid.

5. Cold-start assisting device for an internal combustion engine which drives a device for producing electrical potential and which has a starter for starting the engine, a battery for providing operating potential to the starter, and means for selectively coupling the battery to the starter, the assist system including a source of cold-starting fluid, means for coupling the cold-starting fluid source to the engine's induction system including a cold-starting fluid valve, and an electric circuit for selectively coupling the valve to the device for producing electrical potential for actuation thereby such that the absence of electrical potential from the device prevents operation of the valve through the circuit when the engine is dead.

6. Cold-start assisting device according to claim 5 wherein the circuit also includes a temperature controlled switch which is closed when it is below a predetermined temperature to permit current flow through it to the valve and open when it is above the predetermined temperature to prevent current flow through it to the valve.

7. Cold-start assisting device according to claim 6 further comprising a second circuit for coupling the battery to the temperature controlled switch when the selective coupling means are engaged, such that the actuation of the starter permits operating potential to be available through the temperature controlled switch to the valve when the temperature controlled switch is closed.

8. Cold-start assisting device according to claim 5 further comprising a second circuit for coupling the battery to the valve when the selective coupling means are engaged, such that actuation of the starter permits operating potential to be available through the selective coupling means to the valve when the selective coupling means are engaged.

9. Cold-start assisting device according to claim 8 wherein the first-mentioned and second circuits include, as a common element, a temperature controlled switch which is closed when it is below a predetermined temperature to permit current flow through it to the valve and open when it is above the predetermined temperature to prevent current flow through it to the valve.

10. Cold-start assisting device according to claim 5, wherein the electric circuit includes a multi-position control switch having a position for preventing operation of the valve.

11. Cold-start assisting device according to claim 5, wherein the electric circuit includes a multi-position control switch having a position for connecting the valve to the device for producing electrical potential.

12. Cold-start assisting device according to claim 11, wherein the switch position is a non-latching position.

13. Cold-start assisting device according to claim 11, wherein the electric circuit includes a temperature controlled switch which is closed when it is below a predetermined temperature to permit current flow through it to the valve and open when it is above the predetermined temperature to prevent current flow through it to the valve.

14. Cold-start assisting device according to claim 5, further comprising a second circuit for coupling the battery to the valve when the selective coupling means are engaged, said second circuit including a multi-position control switch having a position for connecting the selective coupling means to the valve such that actuation of the starter permits operating potential to be available through the selective coupling means to the valve when the selective coupling means are engaged.

15. Cold-start assisting device according to claim 14, wherein the position is a latching position.

16. Cold-start assisting device according to claim 14, wherein the first-mentioned and second circuits include, as a common element, a temperature controlled switch which is closed when it is below a predetermined temperature to permit current flow through it to the valve and open when it is above the predetermined temperature to prevent current flow through it to the valve.

* * * * *